US012660876B2

(12) United States Patent
McCray Webb

(10) Patent No.: US 12,660,876 B2
(45) Date of Patent: Jun. 23, 2026

(54) HAIR LOCKING TOOL CHARM

(71) Applicant: Adriane Janice McCray Webb, APO, AA (US)

(72) Inventor: Adriane Janice McCray Webb, APO, AA (US)

( * ) Notice: Subject to any disclaimer, the term of this patent is extended or adjusted under 35 U.S.C. 154(b) by 287 days.

(21) Appl. No.: 18/336,317

(22) Filed: Jun. 16, 2023

(65) Prior Publication Data

US 2024/0415218 A1 Dec. 19, 2024

(51) Int. Cl.
*A41G 5/00* (2006.01)
*A45D 2/00* (2006.01)

(52) U.S. Cl.
CPC ..... *A41G 5/0086* (2013.01); *A45D 2/00* (2013.01); *A45D 2002/008* (2013.01)

(58) Field of Classification Search
CPC ..... A41G 5/0086; A45D 2002/008; A45D 2002/006; A45D 2002/005; A45D 2/00; D05B 85/04; D05B 85/006; D05B 85/06; D05B 87/00; D05B 87/02; D05B 87/04; D05B 91/00
USPC ..... D28/10
See application file for complete search history.

(56) References Cited

U.S. PATENT DOCUMENTS 1,055,058 A * 3/1913 Leighton ..... D05B 85/00 223/102
1,131,621 A * 3/1915 White ..... D04B 3/00 66/118
D252,478 S * 7/1979 Grimes ..... D3/28
4,343,321 A * 8/1982 Caranicas ..... A45D 6/14 132/276
4,955,401 A * 9/1990 Parsons ..... A45D 2/12 132/226
5,357,986 A 10/1994 Hargrett
5,417,230 A * 5/1995 Wood ..... A45D 8/002 132/212

(Continued)

FOREIGN PATENT DOCUMENTS

JP S58188779 U * 12/1983
JP 2011167432 A * 9/2011

OTHER PUBLICATIONS

Clarivate Analytics copyrighted translation of KR20110008219U; publication date Aug. 23, 2011 (Year: 2011).*

(Continued)

*Primary Examiner* — Edelmira Bosques
*Assistant Examiner* — Sarah Woodhouse
(74) *Attorney, Agent, or Firm* — Dunlap Bennett & Ludwig PLLC; Anna L. Kinney

(57) ABSTRACT

A hair locking tool charm has an elongated shaft with a longitudinal channel. The shaft has a cylindrical first end and a tapered second end. The channel has a continuous sidewall parallel to a discontinuous sidewall. The discontinuous sidewall includes two overlapping members with an interspace between. The channel tapers to a narrow end near the first end of the shaft. A method of locking hair with the tool charm includes putting hair in the interspace, manipulating the hair into the narrow end of the channel, and guiding the hair around the first end into a v-shaped notch. Insert the tapered end into a lock or braid, pull the tool charm through, and release the hair from the notch and the channel. When not in use, the tool charm may be worn as an adornment.

11 Claims, 6 Drawing Sheets

(56) References Cited

U.S. PATENT DOCUMENTS

| | | | | |
|---|---|---|---|---|
| 5,806,538 | A * | 9/1998 | Keltner | A45D 8/34 132/273 |
| 5,832,938 | A | 11/1998 | Ybarra | |
| 5,833,335 | A | 11/1998 | Voughlohn | |
| 6,782,896 | B1 * | 8/2004 | Grimes | A45D 8/04 132/273 |
| 6,973,931 | B1 | 12/2005 | King | |
| 8,047,210 | B2 | 11/2011 | Lee | |
| 9,060,768 | B2 * | 6/2015 | Ferragamo | A61B 17/0401 |
| D855,885 | S * | 8/2019 | Moore | D28/39 |
| 10,426,210 | B2 | 10/2019 | Hong | |
| 10,631,610 | B2 | 4/2020 | Bonnemaire et al. | |
| D895,203 | S * | 9/2020 | Hsu | D28/10 |
| D1,018,969 | S * | 3/2024 | Headen | D28/10 |
| 11,992,110 | B1 * | 5/2024 | Elliott | A45D 8/001 |
| D1,060,828 | S * | 2/2025 | Headen | D28/10 |
| 2004/0134509 | A1 * | 7/2004 | Belton | A45D 8/34 132/273 |
| 2007/0163615 | A1 | 7/2007 | Tillon et al. | |
| 2008/0245384 | A1 | 10/2008 | Richman | |
| 2009/0071492 | A1 | 3/2009 | Oh | |
| 2010/0229772 | A1 * | 9/2010 | Turner | D05B 85/02 112/224 |
| 2017/0280801 | A1 * | 10/2017 | Dozier | A41G 3/0066 |
| 2019/0075902 | A1 * | 3/2019 | Moore | A41G 5/0086 |
| 2019/0125050 | A1 | 5/2019 | St Marthe | |
| 2021/0137238 | A1 | 5/2021 | Hemmings et al. | |
| 2021/0145143 | A1 * | 5/2021 | Beasley | A41G 5/0086 |
| 2022/0133018 | A1 * | 5/2022 | Hanson | A45D 44/00 132/212 |
| 2023/0000228 | A1 | 1/2023 | Diop | |

OTHER PUBLICATIONS

Clarivate Analytics copyrighted translation of EP0980927A2; publication date Feb. 23, 2000 (Year: 2000).*

Clarivate Analytics copyrighted translation of JP2005125033A; publication date May 19, 2005 (Year: 2005).*

Clarivate Analytics copyrighted translation of JP3108663U; publication date Apr. 28, 2005 (Year: 2005).*

Katya, https://youtu.be/mwpG5SKuEis?si=7saljaBYZJQCuKDo , publication date Sep. 29, 2017 (Year: 2017).*

Clarivate Analytics copyrighted translation of JP2011167432A; publication date Sep. 1, 2011 (Year: 2011).*

* cited by examiner

HAIR LOCKING TOOL CHARM

BACKGROUND OF THE INVENTION

The present invention relates to hairstyling twisters, tools and, more particularly, to a hair locking tool and charm.

Locks can be formed in hair using an interlocking method performed with a hand tool. A micro-lock is particularly desirable, as it lends itself to greater versatility in hairstyling, more closely resembling a hair strand. During the process, the stylist must establish and maintain control over an isolated section of hair or hair lock as it is threaded through the surrounding hairs without cutting, snagging, tangling, or losing track of the device.

Currently available hair locking devices require the user to employ numerous steps or tools to accomplish the hair locking process, risking injury to the wrists. Some devices latch onto hair with the aid of a spring hook, causing hairs to snag, or become plucked from the follicle as the needle passes through surrounding strands of hair or an isolated hair lock. Some devices are designed to loop hair strands or isolated hair lock around the throat of a needle hook before sliding it into the bowl of needle and repeatedly pulling hair strands or hair lock through the surrounding hair strands or hair lock, reducing the user's control of the isolated hair. The shafts of some hair locking devices are straight (not curved), increasing the possibility for losing control of the isolated hair strand or lock. Many of these devices are too large to create or maintain the more desirable micro-lock.

These devices generally don't work well because they lack multiple features. The open eye of a needle lacks a simple point of entry, requiring hair locks to be directly force-fed into and pulled through the open eye of needle against the natural direction of the hair cuticle, causing hair strands or locks to become frayed and fuzzy. The size of the open eye of the tool is insufficient to accommodate and secure various sizes of hair locks, particularly micro-locks, making it difficult and time-consuming to repeatedly feed the isolated hair lock through the eye. The shape and size of the tool's shaft is not ergonomically designed to effectively achieve and maintain the micro-lock hairstyle. They lack a fastener to ensure that hair strands or lock are secure when passing through the surrounding hair strands when forming the micro-lock, attaching a hair weft to track, or feeding loose hair through braids. They lack the versatility necessary for interlocking hair, attaching hair wefts and slip knotting added hair. They do not possess a means of creating an organized grid pattern of sections on scalp. The straight shaft does not provide for easy entry into and exit from surrounding hair strands, hair locks, braids, or tracks. They do not possess a bent tip for directing tool through hair during the interlocking process. They do not prevent snagging, plucking, and tangling stray hairs during the hair locking process.

As can be seen, there is a need for a hair locking device that can help demarcate a uniformed grid pattern on scalp for creating micro-locks having a guiding arm and open eye which is embedded within the tool possessing an ergonomically designed body to accommodate and secure various sizes of hair locks with a simple point of entry and exit, or attach hair weft to tracks, feed loose hair through braids, or slipknot added hair while preventing cutting, snagging, plucking, and tangling.

SUMMARY OF THE INVENTION

In one aspect of the present invention, a hair locking tool charm comprises an elongated shaft having a length extending in a longitudinal direction and having a substantially cylindrical first end a tapered second end and a substantially flat portion disposed between the substantially cylindrical first end and the tapered second portion, the substantially flat portion having a substantially rectangular cross-section, the substantially cylindrical first portion and the substantially flat portion being joined by a first concavity, the substantially flat portion and the tapered second portion being joined by a second concavity; wherein the substantially cylindrical first portion extends between a first end and an opposing second end, the first end defining a terminal end of the hair locking tool charm, a length of the cylindrical first portion being greater than a diameter of the cylindrical first portion; and a longitudinal channel, formed in the substantially flat portion of the elongated shaft, having a continuous sidewall and a discontinuous sidewall disposed parallel to the continuous sidewall, said discontinuous sidewall comprising two overlapping members forming an interspace therebetween; wherein the longitudinal channel tapers to a narrow end proximate the substantially cylindrical first end.

In another aspect of the present invention, a method of locking hair with the hair locking tool charm comprises engaging hair in the interspace; manipulating the hair into the longitudinal channel; urging the hair into the narrow end; guiding the hair around the substantially cylindrical first end into a v-shaped notch formed therein; inserting the tapered second end into a lock, braid or track; pulling the hair locking tool charm through the hair lock, strands of hair, braid or track; and releasing the hair from the v-shaped notch and the narrow end of the longitudinal channel.

The inventive tool charm securely fastens the isolated hair during the hair locking, attachment or weaving process without cutting, snagging, tangling, or losing the strand in surrounding hairs during the hair locking process. It may be gently and easily pulled through surrounding hair strands, hair lock or track as they trail behind along the pathway created by the bent tip of the tool charm. The device reduces the number of hair-locking steps, combining them all into use of one tool charm.

This device is a functional piece of art. The tool charm may be used to install hair weaves, hair extensions and toupees; to make closures, wigs, and hair wefts. It may be used in the crafting, fashion, or surgical field, or anywhere stitches are needed. When not in use, it may be worn as an adornment such as a piece of jewelry, charm, hair, or clothing ornament, or it may be used as an accessory by threading a strip of metal, leather, fabric, or other material through the pierced round hole at the top of device.

These and other features, aspects and advantages of the present invention will become better understood with reference to the following drawings, description, and claims.

DETAILED DESCRIPTION OF THE INVENTION

Figure 1:
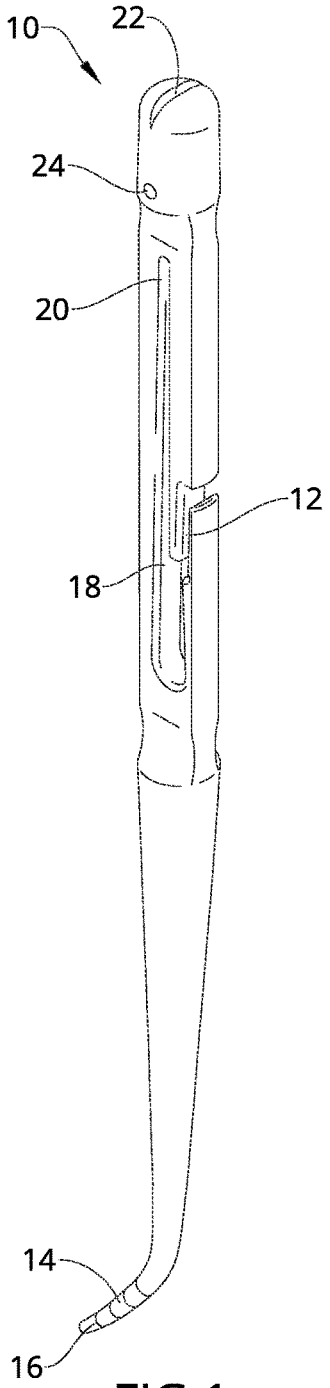
FIG. 1 is a front perspective view of a hair locking tool charm according to an embodiment of the present invention.
Figure 2:
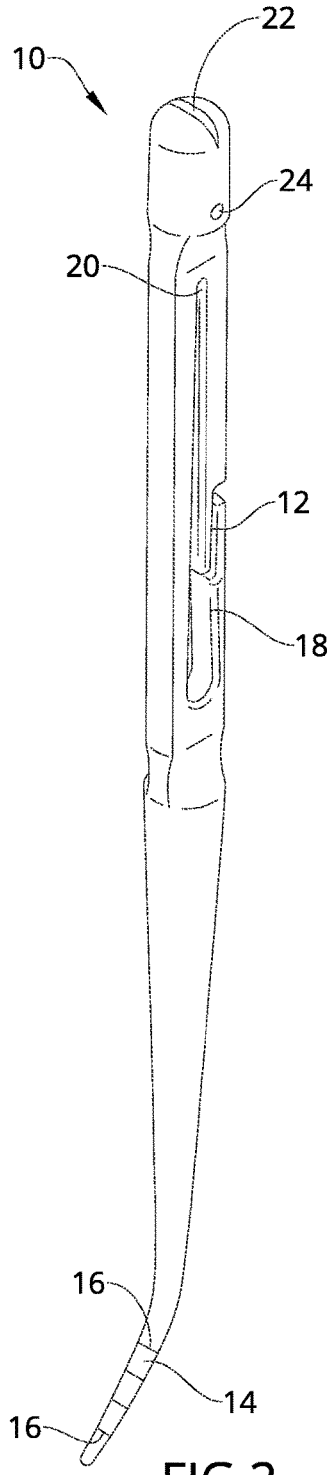
FIG. 2 is a rear perspective view thereof.
Figure 3:
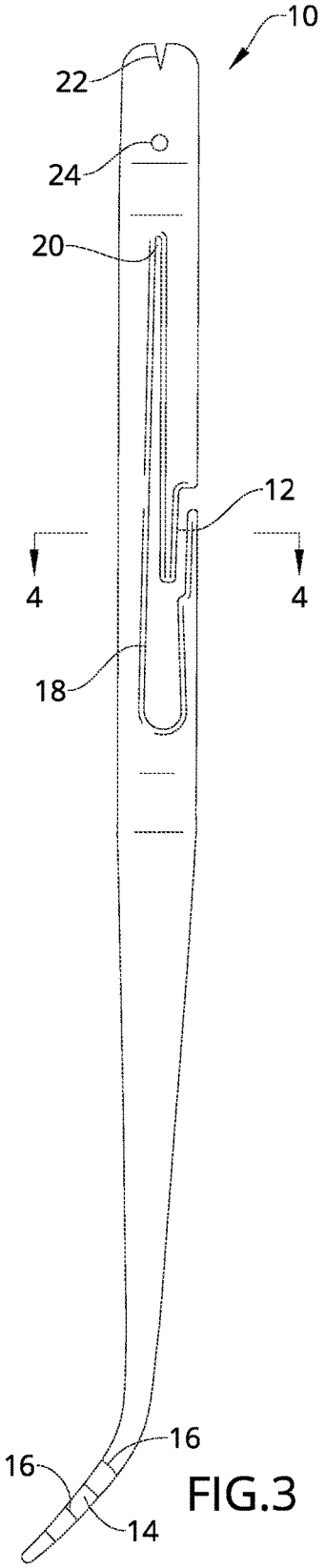
FIG. 3 is a front elevation view thereof.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a "self-threading", "embedded eye" hair locking charm.

The device has a smaller circumference than prior art hair locking devices, so it passes through hair strands and micro hair locks more easily, making the creation and maintenance of micro hair locks easier and less time-consuming.

The charm has a shaft with a blunt end, an outer overlapping arm stemming therefrom and arching over an open eye located in a concave housing to form a first channel wide enough to introduce a hair lock into the open eye, and a tongue to guide hair down a second narrowing channel. The tongue extends backward into the open eye.

In some embodiments, the shaft may be curved and/or textured for better control. The bent tip of the device directs the needle in an upward direction after passing through surrounding hair strands, hair lock, braid, or track, making the device easier to locate and reducing the possibility of stray hair strands becoming tangled in the isolated section of hair strands or hair lock. In some embodiments, the tip is bent at an obtuse angle, which lessens repetitive wrist rotations that could potentially lead to carpal tunnel disease.

In other embodiments, the shaft may be straight.

In other embodiments, the shaft may be twisted to mimic the natural curl pattern of hair.

In other embodiments, the shaft may be smooth.

In some embodiments, the tool charm may have a hole punched above the open eye of the charm.

The size, length, and weight of the tool charm are not particularly limited as size, length, and weight may vary to accommodate size, length and width of hair strand, hair lock or braid. For example, the tool charm may be about 2-3 inches long and about 0.16-0.25 inches wide.

The material of manufacture is not particularly limited. The tool charm may be made, for example, of plastic, metal, wood, stone, resin, and any combination thereof.

The method of manufacture is not particularly limited. For example, the tool charm may be carved or formed in a mold and cured.

To use the tool charm, the user may gather a section of hair strands, hair lock or thread and feed it into a first channel between an outer arm and side arm. Moving the gathered strand hair or hair lock past a tongue, into the open eye of the needle, the user may guide the hair or hair lock upwards into a second narrowing channel until the hair reaches a place along the channel which best accommodates its size and fastened into the v-notch to prevent slippage to ensure sanitary conditions by reducing the possibility of the hair tool charm dropping onto unsanitary surfaces. The user may insert the blunt, bent tip of the tool charm through hair strands or a hair lock, drawing the secured hair through and repeat until a desired shape, size, length, or the desired amount or retightening of the hair lock is achieved. The user threads hair in and out of hair strands/locks with the inventive device, much in the way one would with a crafting, fashion, or surgical needle. The strands of hair, thread or finished hair lock may be released by gently guiding it out of the second narrowing channel and into the open eye of the needle. Progressing to the next section of hair, the user may repeat the procedure until the complete head of hair is locked, weft secured to track, loose hair strands slip knotted or secured to braid or track.

Midway along the tool charm, the body has a concave region for smooth entry and exit through hair. The tool charm narrows inward to create an opening to receive hair. The edges of the eye and its channels are smooth and curvy so as to not damage or cut hair that is pinched into the narrowest section of the embedded opening. The sidewalls around the embedded eye of the tool charm are recessed and are substantially flat and concave. The end portions of the tool charm are generally cylindrical.

Figure 4:
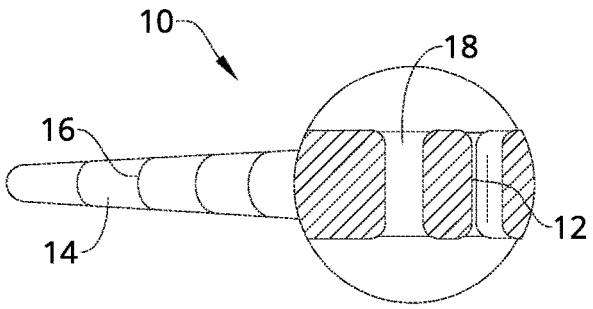
FIG. 4 is a sectional view thereof, taken along line 4-4 in FIG. 3.
Figure 5:
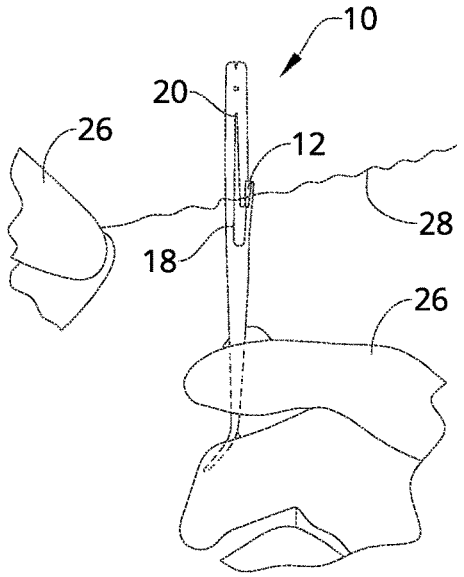
FIG. 5 is another front elevation view, shown in use.
Figure 6:
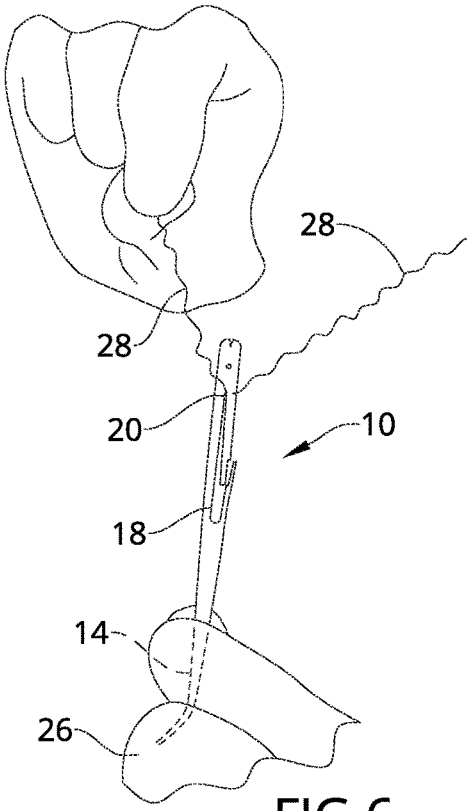
FIG. 6 is another front elevation view thereof, shown in use.
Figure 7:
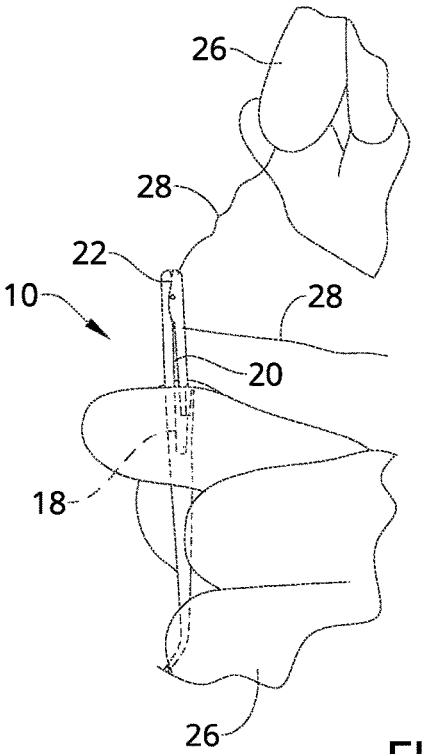
FIG. 7 is another front elevation view thereof, shown in use.
Figure 8:
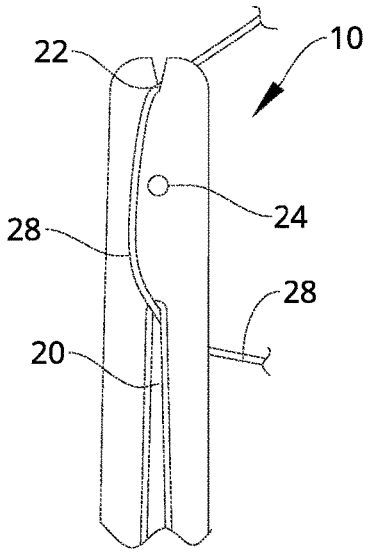
FIG. 8 is a detail view thereof, shown in use.
Figure 9:
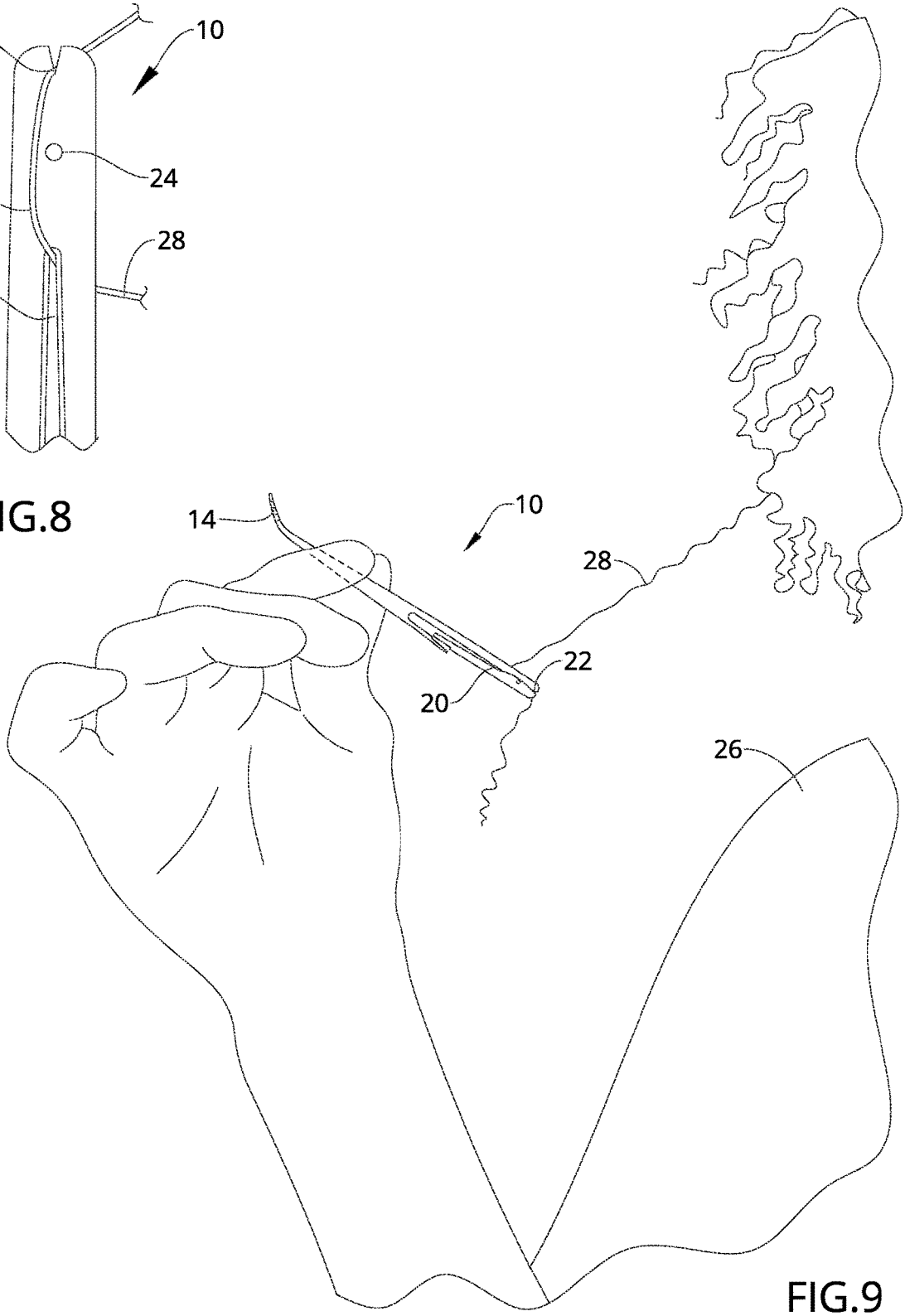
FIG. 9 is another front elevation view thereof, shown in use.
Figure 10:
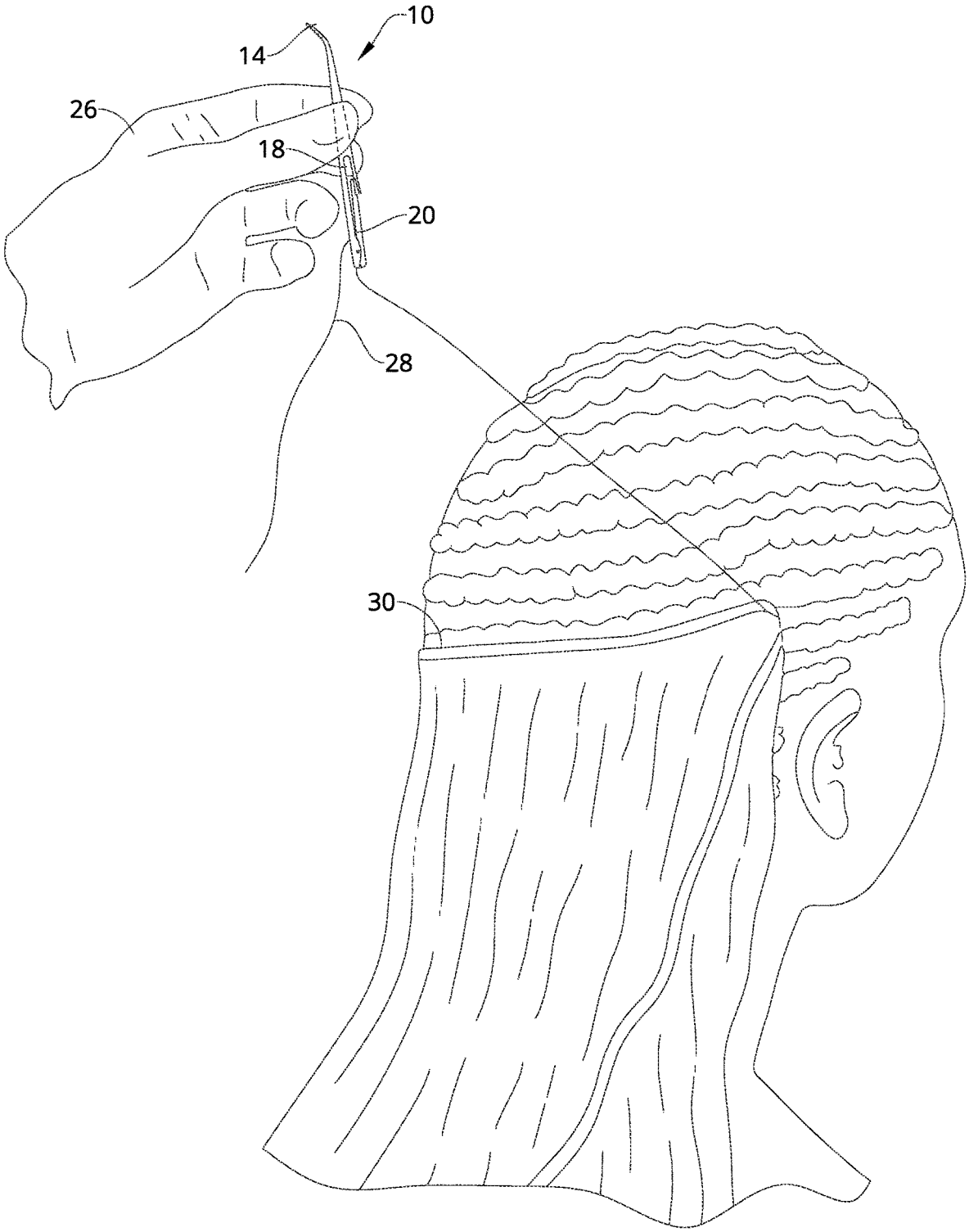
FIG. 10 is another front elevation view thereof, shown in use.
Figure 11:
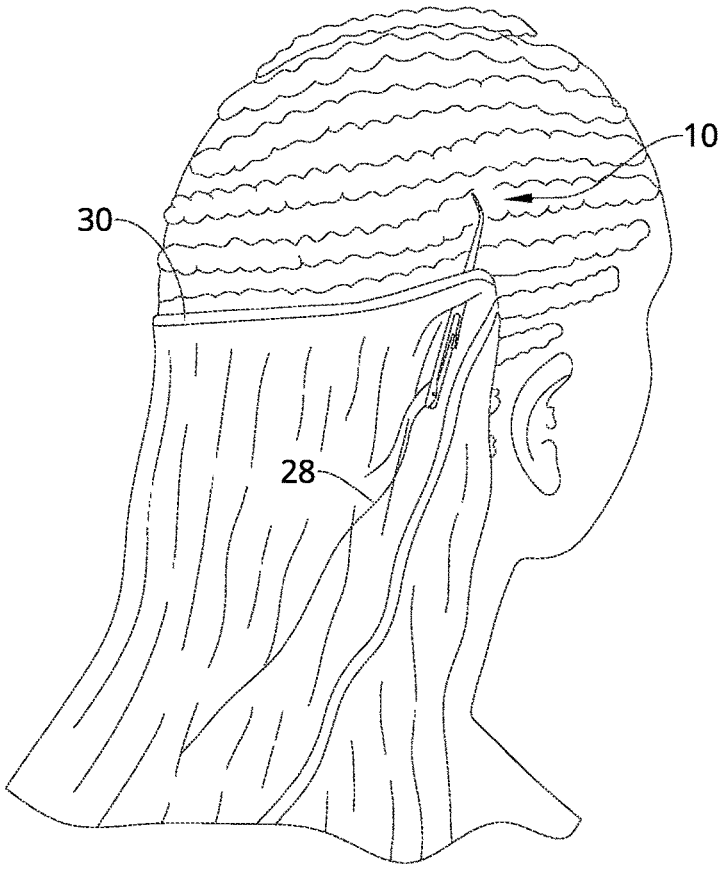
FIG. 11 is another front elevation view thereof, shown in use.
Figure 12:
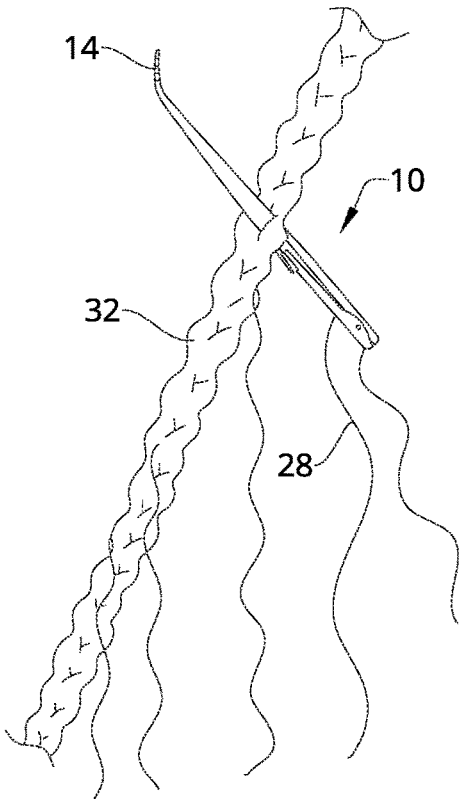
FIG. 12 is another front elevation view thereof, shown in use.
Figure 13:
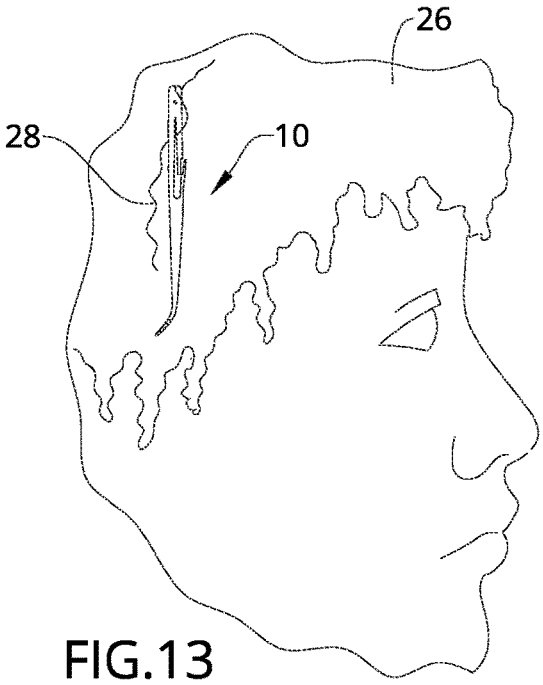
FIG. 13 is another front elevation view thereof, shown in use.

Referring to FIGS. 1 through 16, FIGS. 1 through 3 show a hair locking tool charm 10 having a bent tip 14 at one end and a rounded tip at a second end with a tip notch 22 formed therein. The bent tip has demarcations 16 scored around the circumference of its surface with marked spaces for measuring sections of hair to create a uniformed grid pattern onto the scalp when parting; see FIG. 4. The tool charm 10 has a shaft with a first arm and a tongue forming a slotted expandable eye 12 therebetween.

As shown in FIGS. 5 through 13, a strand of hair 28 may be inserted into the center channel 18, moved to the narrow tip 20 thereof, and passed over the notch 22 to secure it in place. The tool charm 10 may then be used to weave the hair 28 through a braided track 30 or through an existing braid 32.

Figure 14:
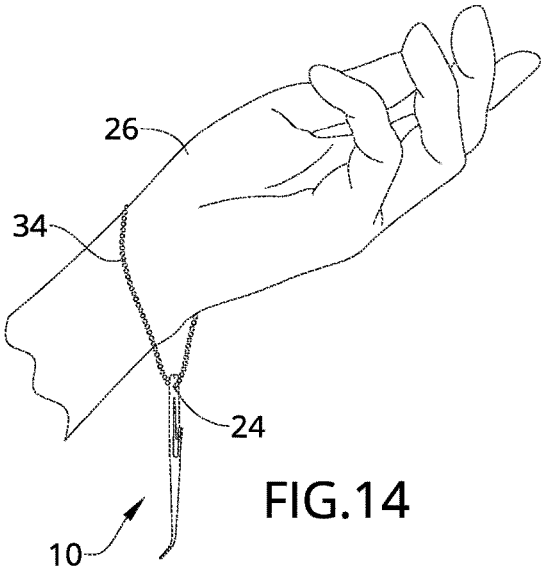
FIG. 14 is another front elevation view thereof, shown in use.
Figure 15:
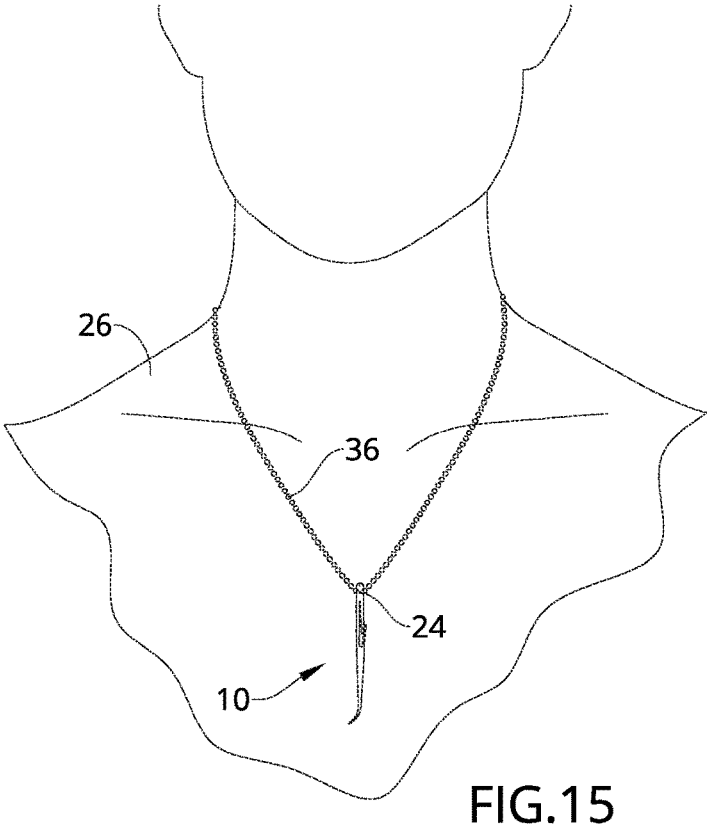
FIG. 15 is another front elevation view thereof, shown in use.
Figure 16:
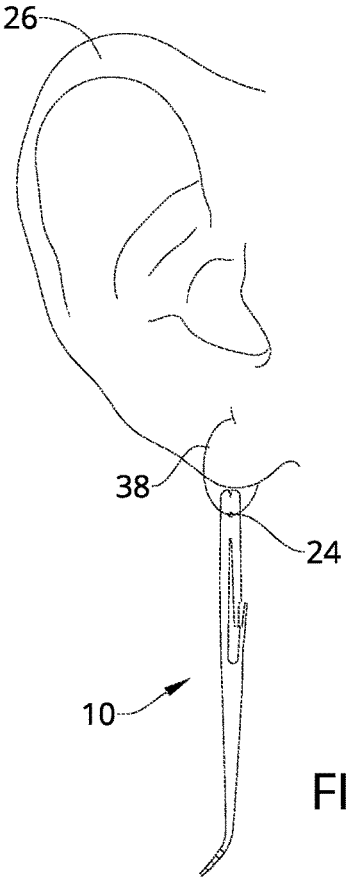
FIG. 16 is another front elevation view thereof, shown in use.

A bore 24 formed in the tool charm between the eye 12 and the notch 22 can accommodate a variety of suspension devices, such as a bracelet 34, a necklace 36, an earring 38, or hair enabling the user 26 to wear the tool charm 10 as a charm, as seen in FIGS. 14 through 16.

It should be understood, of course, that the foregoing relates to exemplary embodiments of the invention and that modifications may be made without departing from the spirit and scope of the invention as set forth in the following claims.

What is claimed is:

1. A hair locking tool charm comprising:

an elongated shaft having a length extending in a longitudinal direction and having a first portion, the first portion being substantially cylindrical, a tapered second portion, and a substantially flat portion disposed between the first portion and the tapered second portion;

the substantially flat portion comprising a substantially rectangular cross-section with first and second opposing sides of the substantially flat portion being joined to the first portion by a first concavity;

the first and second opposing sides of the substantially flat portion being joined to the tapered second portion by a second concavity;

wherein the first portion comprises a proximal end and an opposing distal end, the proximal end defining a terminal end of the hair locking tool charm wherein the terminal end comprises a v-shaped notch extending diametrically thereacross and formed entirely within the first portion;

a length of the cylindrical first portion being greater than a diameter of the cylindrical first portion; and a longitudinal channel, spaced apart and separate from the v-shaped notch and formed entirely within the substantially flat portion, said longitudinal channel having a narrow end proximate the proximal end of the first portion and a wide end distal from the proximal end of the first portion, the wide end positioned at an intermediate location along the elongated shaft proximate the second concavity, said longitudinal channel comprising a continuous sidewall extending between the wide end and the narrow end; and a discontinuous sidewall disposed opposite the continuous sidewall, said discontinuous sidewall comprising two overlapping members that define an interspace therebetween;

wherein the longitudinal channel tapers from the wide end to the narrow end; and wherein the interspace intersects with the longitudinal channel at a position proximate to the wide end.

2. The hair locking tool charm of claim 1, wherein the continuous sidewall and the discontinuous sidewall define a first substantially flat longitudinal face and a second substantially flat longitudinal face, wherein the first substantially flat longitudinal face and the second substantially flat longitudinal face are recessed relative to the first portion.

3. The hair locking tool charm of claim 1, wherein the v-shaped notch opens opposite the longitudinal channel.

4. The hair locking tool charm of claim 1, wherein the first portion has a borehole defined diametrically therethrough, wherein the borehole extends orthogonal to a length of the longitudinal channel.

5. The hair locking tool charm of claim 1, wherein the elongated shaft is conical in shape from a distal end of the second concave region to the tapered second portion.

6. The hair locking tool charm of claim 1, wherein the elongated shaft comprises a bend at a distal end of the tapered second portion, wherein the bend is disposed at an obtuse angle to the first portion.

7. The hair locking tool charm of claim 1, wherein circumferential score marks orthogonal to a longitudinal axis of the elongated shaft are formed around the tapered second portion.

8. A method of locking hair with the hair locking tool charm of claim 1, comprising:

engaging hair in the interspace;

manipulating the hair into the longitudinal channel;

urging the hair into the narrow end;

guiding the hair around the first portion into the v-shaped notch formed therein;

inserting the tapered second portion into a lock or braid;

pulling the hair locking tool charm through the lock or braid; and releasing the hair from the v-shaped notch and the narrow end of the longitudinal channel.

9. The method of claim 8, further comprising repeating the steps of inserting the tapered second portion into a lock or braid and pulling the hair locking tool charm through the lock or braid until a predetermined pattern is achieved.

10. The method of claim 8, wherein the hair locking tool charm retains the hair against unintended release during the steps of inserting and pulling.

11. The hair locking tool charm of claim 1, wherein the continuous sidewall and the discontinuous sidewall define a first substantially flat longitudinal face and a second substantially flat longitudinal face, wherein the first substantially flat longitudinal face and the second substantially flat longitudinal face are recessed relative to the substantially cylindrical first portion;

wherein the elongated shaft comprises a bend at a distal end of the tapered second portion such that the bend is disposed at an obtuse angle to the substantially cylindrical first portion; and wherein a plurality of circumferential score marks orthogonal to a longitudinal axis of the elongated shaft are formed around the tapered second portion.

* * * * *